US006463895B2

(12) United States Patent
Bailey

(10) Patent No.: US 6,463,895 B2
(45) Date of Patent: Oct. 15, 2002

(54) FREE PISTON INTERNAL COMBUSTION ENGINE WITH PULSE COMPRESSION

(75) Inventor: Brett M. Bailey, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/833,889

(22) Filed: Apr. 12, 2001

(65) Prior Publication Data

US 2001/0020453 A1 Sep. 13, 2001

Related U.S. Application Data

(63) Continuation of application No. 09/255,110, filed on Feb. 22, 1999.

(51) Int. Cl.[7] ..... F02B 71/00
(52) U.S. Cl. ..... 123/46 R; 123/45 SC
(58) Field of Search ..... 123/46 R, 46 SC

(56) References Cited

U.S. PATENT DOCUMENTS

| | | | | | |
|---|---|---|---|---|---|
| 3,182,895 | A | * | 5/1965 | Panhard | 123/46 |
| 3,606,591 | A | * | 9/1971 | Potma | 123/46 SC |
| 4,210,064 | A | | 7/1980 | Beerens | 91/394 |
| 4,599,861 | A | | 7/1986 | Beaumont | 60/595 |
| 4,705,460 | A | * | 11/1987 | Braun | 123/46 SC |
| 4,992,031 | A | | 2/1991 | Sampo | 417/364 |
| 5,540,194 | A | * | 7/1996 | Adams | 123/46 R |
| 5,775,273 | A | | 7/1998 | Beale | 123/46 B |

FOREIGN PATENT DOCUMENTS

| | | | |
|---|---|---|---|
| EP | 0 254 353 | 1/1988 | F02B/71/04 |
| EP | 0 280 200 | 5/1992 | F02B/71/04 |
| EP | 0 481 690 A2 | 4/1997 | |
| NL | 6 814 405 | 4/1970 | F02B/71/04 |
| WO | 93/10341 | 5/1993 | F02B/71/02 |
| WO | 93/10342 | 5/1993 | F02B/71/04 |
| WO | 93/10343 | 5/1993 | F02B/71/04 |
| WO | 93/10344 | 5/1993 | F02B/71/04 |
| WO | 93/10345 | 5/1993 | F02B/71/04 |
| WO | WO93/10345 | 5/1993 | |
| WO | 96/03575 | 2/1996 | F02B/71/02 |
| WO | 9603576 A1 | 2/1996 | F02B/71/04 |
| WO | 96/32576 | 10/1996 | F02B/71/04 |
| WO | WO98/54450 | 12/1998 | |

OTHER PUBLICATIONS

WO 93/10344, Achten et al., Nov. 1991, PCT.*

(List continued on next page.)

*Primary Examiner*—Gene Mancene
*Assistant Examiner*—Jason Benton
(74) *Attorney, Agent, or Firm*—Todd Taylor

(57) ABSTRACT

A free piston internal combustion engine includes a housing with a combustion cylinder and a hydraulic cylinder. A piston includes a piston head reciprocally disposed within the combustion cylinder and movable during a compression stroke to a top dead center position and during a return stroke to a BDC position. A plunger head is reciprocally disposed within the hydraulic cylinder. A plunger rod interconnects and is rigidly affixed to each of the piston head and the plunger head. The plunger head and the hydraulic cylinder define a variable volume pressure chamber on a side of the plunger head generally opposite the plunger rod. At least one valve interconnects a hydraulic accumulator with the pressure chamber during a portion of the compression stroke to act on the plunger head and thereby move the piston head toward the top dead center position, and interconnects the hydraulic accumulator with the pressure chamber during the return stroke to pressurize the hydraulic accumulator during movement of the piston head toward the BDC position.

15 Claims, 3 Drawing Sheets

OTHER PUBLICATIONS

Application Ser. No. 08/974,326, filed Nov. 19, 1997, entitled "Two Cycle Engine Having a Mono–Value Integrated with a Fuel Injector".

Application Ser. No. 08/978,329, filed Nov. 25, 1997, entitled "Hydraulic Apparatus with Improved Accumulator for Reduced Pressure . . . ".

Application Ser. No. 09/151,267 filed Sep. 11, 1998, entitled "Method for Operation of a Free Piston Engine".

Application Ser. No. 09/225,525 filed Jan. 4, 1999, entitled "Fuel Injector Assembly Tool and Method".

TU Dresden—publication date unknown, earliest date 1993, Dresden University in Germany.

WO 93/10344, Achten et al., Nov. 1991, PCT.

* cited by examiner

FREE PISTON INTERNAL COMBUSTION ENGINE WITH PULSE COMPRESSION

This is a continuation of application Ser. No. 09/255,110 filed Feb. 22, 1999.

TECHNICAL FIELD

The present invention relates to free piston internal combustion engines, and, more particularly, to free piston internal combustion engines with a hydraulic power output.

BACKGROUND ART

Internal combustion engines typically include a plurality of pistons which are disposed within a plurality of corresponding combustion cylinders. Each of the pistons is pivotally connected to one end of a piston rod, which in turn is pivotally connected at the other end thereof with a common crankshaft. The relative axial displacement of each piston between a top dead center (TDC) position and a bottom dead center (BDC) position is determined by the angular orientation of the crank arm on the crankshaft with which each piston is connected.

A free piston internal combustion engine likewise includes a plurality of pistons which are reciprocally disposed in a plurality of corresponding combustion cylinders. However, the pistons are not interconnected with each other through the use of a crankshaft. Rather, each piston is typically rigidly connected with a plunger rod which is used to provide some type of work output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the TDC position. The TDC position and the BDC position may change from one stroke to the next.

In a free piston engine with a hydraulic power output as described above, the pressure chamber in the hydraulic cylinder which carries the plunger is only connected with the high pressure hydraulic s accumulator when the piston head is moving toward the BDC position during a return stroke. During a compression stroke, only a low pressure hydraulic accumulator is connected with the pressure chamber in the hydraulic cylinder which carries the plunger. Since the high pressure fluid in the compression cylinder acts to move the piston head toward the TDC position, and since the cross-sectional area of the plunger head is relatively small and hence does not proportionately significantly add a large amount of additional axial force to the plunger, the high pressure hydraulic accumulator is not connected with the pressure chamber in the hydraulic cylinder during the compression stroke to avoid bleeding off any of the pressure previously built up in the high pressure hydraulic accumulator.

SUMMARY OF THE INVENTION

The present invention provides a free piston engine in which a pulse of high pressure is provided from the high pressure hydraulic accumulator to the hydraulic cylinder to in turn provide the piston head with enough kinetic energy to effect proper compression within the combustion chamber. The plunger in the hydraulic cylinder provides the dual functionality of moving the piston head toward a TDC position during a compression stroke and pressurizing fluid in the high pressure hydraulic accumulator during a return stroke.

In one aspect of the invention, a free piston internal combustion engine includes a housing with a combustion cylinder and a hydraulic cylinder. A piston includes a piston head reciprocally disposed within the combustion cylinder and movable during a compression stroke to a TDC position and during a return stroke to a BDC position. A plunger head is reciprocally disposed within the hydraulic cylinder. A plunger rod interconnects and is substantially rigidly affixed to each of the piston head and the plunger head. The plunger head and the hydraulic cylinder define a variable volume pressure chamber on a side of the plunger head generally opposite the plunger rod. At least one valve interconnects a hydraulic accumulator with the pressure chamber during a portion of the compression stroke to act on the plunger head and thereby move the piston head toward the TDC position, and interconnects the hydraulic accumulator with the pressure chamber during substantially all of the return stroke to pressurize the hydraulic accumulator during movement of the piston head toward the EDC position.

An advantage of the present invention is that the fluid pressure in the pressure chamber in the hydraulic cylinder is used both to move the piston head to the TDC position during a compression stroke and to pressurize the hydraulic accumulator during a return stroke.

Another advantage is that the same high pressure accumulator can be used both during the compression stroke and during the return stroke.

Yet another advantage is that only a pulse of high pressure energy is provided from the high pressure hydraulic accumulator during the compression stroke, and the high pressure hydraulic accumulator receives high pressure energy during substantially all of the return stroke, thereby resulting in a net positive gain in energy.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
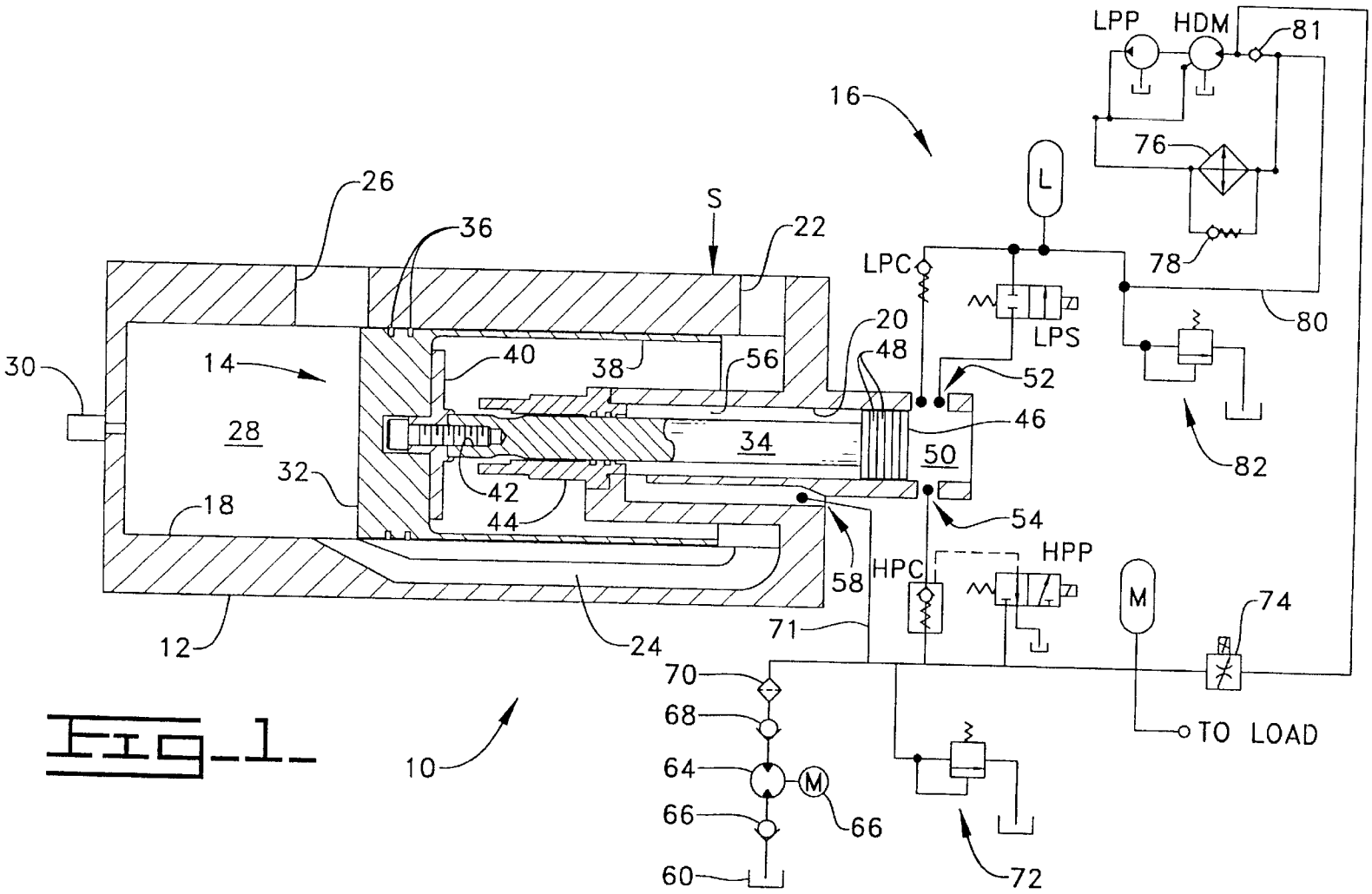
FIG. 1 is a schematic illustration of an embodiment of a free piston engine of the present invention.

Referring now to the drawings, and more particularly to FIG. 1, there is shown an embodiment of a free piston internal combustion engine 10 of the is present invention which generally includes a housing 12, piston 14, and hydraulic circuit 16.

Housing 12 includes a combustion cylinder 18 and a hydraulic cylinder 20. Housing 12 also includes a combustion air inlet 22, air scavenging channel 24 and exhaust outlet 26 which are disposed in communication with a combustion chamber 28 within combustion cylinder 18. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 18 and is moveable during a compression stroke toward a TDC position and during a return stroke toward a BDC position. Piston 14 generally includes a piston head 32 which is attached to a plunger rod 34. Piston head 32 is formed from a metallic material in the embodiment shown, such as aluminum or steel, but may be formed from another material having suitable physical properties such as coefficient of friction, coefficient of thermal expansion and temperature resistance. For example, piston head 32 may be formed from a non-metallic material such as a composite or ceramic material. More particularly, piston head 32 may be formed from a carbon-carbon composite material with carbon reinforcing fibers which are randomly oriented or oriented in one or more directions within the carbon and resin matrix.

Piston head 32 includes two annular piston ring grooves 36 in which are disposed a pair of corresponding piston rings (not numbered) to attain cylinder pressure needed for combustion compression, combustion and expansion, and prevent blow-by of combustion products. Any number of piston ring grooves and piston rings may be used without changing the essence of the invention. If piston head 32 is formed from a suitable non-metallic material having a relatively low coefficient of thermal expansion, it is possible that the radial operating clearance between piston head 32 and the inside surface of combustion cylinder 18 may be reduced such that piston ring grooves 36 and the associated piston rings may not be required. Piston head 32 also includes an elongated skirt 38 which lies adjacent to and covers exhaust outlet 26 when piston 14 is at or near a TDC position, thereby preventing combustion air which enters through combustion air inlet 22 from exiting out exhaust outlet 26.

Plunger rod 34 is substantially rigidly attached to piston head 32 at one end thereof using a mounting hub 40 and a bolt 42. Bolt 42 extends through a hole (not numbered) in mounting hub 40 and is threadingly engaged with a corresponding hole formed in the end of plunger rod 34. Mounting hub 40 is then attached to the side of piston head 32 opposite combustion chamber 28 in a suitable manner, such as by using bolts, welding, and/or adhesive, etc. A bearing/seal 44 surrounding plunger rod 34 and carried by housing 12 separates combustion cylinder 18 from hydraulic cylinder 20.

Plunger head 46 is substantially rigidly attached to an end of plunger rod 34 opposite from piston head 32. Reciprocating movement of piston head 32 between a BDC position and a TDC position, and vice versa, causes corresponding reciprocating motion of plunger rod 34 and plunger head 46 within hydraulic cylinder 20. Plunger head 46 includes a plurality of sequentially adjacent lands and valleys 48 which effectively seal with and reduce friction between plunger head 46 and an inside surface of hydraulic cylinder 20.

Plunger head 46 and hydraulic cylinder 20 define a variable volume pressure chamber 50 on a side of plunger head 46 generally opposite from plunger rod 34. The volume of pressure chamber 50 varies depending upon the longitudinal position of plunger head 46 within hydraulic cylinder 20. A fluid port 52 and a fluid port 54 are fluidly connected with variable volume pressure chamber 50. An annular space 56 surrounding plunger rod 34 is disposed in fluid communication with a fluid port 58 in housing 12. Fluid is drawn through fluid port 58 into annular space 56 upon movement of plunger rod 34 and plunger head 46 toward a BDC position so that a negative pressure is not created on the side of plunger head 46 opposite variable volume pressure chamber 50. The effective cross-sectional area of pressurized fluid acting on plunger head 46 within variable volume pressure chamber 50 compared with the effective cross-sectional area of pressured fluid acting on plunger head 46 within annular space 56, is a ratio of between approximately 5:1 to 30:1. In the embodiment shown, the ratio between effective cross-sectional areas acting on opposite sides of plunger head 46 is approximately 20:1. This ratio has been found suitable to prevent the development of a negative pressure within annular space 56 upon movement of plunger head 46 toward a BDC position, while at the same time not substantially adversely affecting the efficiency of free piston engine 10 while plunger head 46 is traveling toward a TDC position.

Hydraulic circuit 16 is connected with hydraulic cylinder 20 and provides a source of pressurized fluid, such as hydraulic fluid, to a load for a specific application, such as a hydrostatic drive unit (not shown). Hydraulic circuit 16 generally includes a high pressure hydraulic accumulator (H), a low pressure hydraulic accumulator (L), and suitable valving, etc. used to connect high pressure hydraulic accumulator H and low pressure hydraulic accumulator L with hydraulic cylinder 20 at selected points in time as will be described in greater detail hereinafter.

More particularly, hydraulic circuit 16 receives hydraulic fluid from a source 60 to initially charge high pressure hydraulic accumulator H to a desired pressure. A starter motor 62 drives a fluid pump 64 to pressurize the hydraulic fluid in high pressure hydraulic accumulator H. The hydraulic fluid transported by pump 64 flows through a check valve 66 on an input side of pump 64, and a check valve 68 and filter 70 on an output side of pump 64. The pressure developed by pump 64 also pressurizes annular space 56 via the interconnection with line 71 and fluid port 58. A pressure relief valve 72 ensures that the pressure within high pressure hydraulic accumulator H does not exceed a threshold limit.

The high pressure hydraulic fluid which is stored within high pressure hydraulic accumulator H is supplied to a load suitable for a specific application, such as a hydrostatic drive unit. The high pressure within high pressure hydraulic accumulator H is initially developed using pump 64, and is thereafter developed and maintained using the pumping action of free piston engine 10.

A proportional valve 74 has an input disposed in communication with high pressure hydraulic accumulator H, and provides the dual functionality of charging low pressure hydraulic accumulator L and providing a source of fluid power for driving ancillary mechanical equipment on free piston engine 10. More particularly, proportional valve 74 provides a variably controlled flow rate of high pressure hydraulic fluid from high pressure hydraulic accumulator H to a hydraulic motor HDM. Hydraulic motor HDM has a rotating mechanical output shaft which drives ancillary equipment on free piston engine 10 using a belt and pulley arrangement, such as a cooling fan, alternator and water pump. Of course, the ancillary equipment driven by hydraulic motor HDM may vary from one application to another.

Hydraulic motor HDM also drives a low pressure pump LPP which is used to charge low pressure hydraulic accumulator L to a desired pressure. Low pressure pump LPP has a fluid output which is connected in parallel with each of a heat exchanger 76 and a check valve 78. If the flow rate through heat exchanger 76 is not sufficient to provide an adequate flow for a required demand, the pressure differential on opposite sides of check valve 78 causes check valve 78 to open, thereby allowing hydraulic fluid to by-pass heat exchanger 76 temporarily. If the pressure developed by low pressure pump LPP which is present in line 80 exceeds a threshold value, check valve 81 opens to allow hydraulic fluid to bleed back to the input side of hydraulic motor HDM. A pressure relief valve 82 prevents the hydraulic fluid within line 80 from exceeding a threshold value.

Low pressure hydraulic accumulator L selectively provides a relatively lower pressure hydraulic fluid to pressure chamber 50 within hydraulic cylinder 20 using a low pressure check valve (LPC) and a low pressure shutoff valve (LPS). Conversely, high pressure hydraulic accumulator H provides a higher pressure hydraulic fluid to pressure chamber 50 within hydraulic cylinder 20 using a high pressure check valve (HPC) and a high pressure pilot valve (HPP).

During an initial startup phase of free piston engine 10, starter motor 62 is energized to drive pump 64 and thereby pressurize high pressure hydraulic accumulator H to a desired pressure. Since piston 14 may not be at a position which is near enough to the BDC position to allow effective compression during a compression stroke, it may be necessary to effect a manual return procedure of piston 14 to a BDC position. To wit, low pressure shutoff valve LPS is opened using a suitable controller to minimize the pressure on the side of hydraulic plunger 46 which is adjacent to pressure chamber 50. Since annular space 56 is in communication with high pressure hydraulic accumulator H, the pressure differential on opposite sides of hydraulic plunger 46 causes piston 14 to move toward the BDC position, as shown in FIG. 1.

When piston 14 is at a position providing an effective compression ratio within combustion chamber 28, high pressure pilot valve HPP is actuated using a controller to manually open high pressure check valve HPC, thereby providing a pulse of high pressure hydraulic fluid from high pressure hydraulic accumulator into pressure chamber 50. Low pressure check valve LPC and low pressure shutoff valve LPS are both closed when the pulse of high pressure hydraulic fluid is provided to pressure chamber 50. The high pressure pulse of hydraulic fluid causes plunger head 46 and piston head 32 to move toward the TDC position. Because of the relatively large ratio difference in cross-sectional areas on opposite sides of plunger head 46, the high pressure hydraulic fluid which is present within annual space 56 does not adversely interfere with the travel of plunger head 46 and piston head 32 toward the TDC position. The pulse of high pressure hydraulic fluid is applied to pressure chamber 50 for a period of time which is sufficient to cause piston 14 to travel with a kinetic energy which will effect combustion within combustion chamber 28. The pulse may be based upon a time duration or a sensed position of piston head 32 within combustion cylinder 18.

As plunger head 46 stops at the BDC position and flow into high pressure hydraulic accumulator H stops, the pressure in pressure chamber 50 will equalize with the pressure in the high pressure hydraulic accumulator H, thereby allowing high pressure check valve HPC to shut. As plunger head 46 travels toward the TDC position, the volume of pressure chamber 50 increases after high pressure is shut off. The increased volume in turn results in a decrease in the pressure within pressure chamber 50 and low pressure check valve LPC will open. The relatively lower pressure hydraulic fluid which is in low pressure hydraulic accumulator L thus fills the volume within pressure chamber 50 as plunger head 46 travels toward the TDC position. By using only a pulse of pressure from high pressure hydraulic accumulator H during a beginning portion of the compression stroke (e.g., during 60% of the stroke length), followed by a fill of pressure chamber 50 with a lower pressure hydraulic fluid from low pressure hydraulic accumulator L, a net resultant gain in pressure within high pressure hydraulic accumulator H is achieved.

By properly loading combustion air and fuel s into combustion chamber 28 through air scavenging channel 24 and fuel injector 30, respectively, proper combustion occurs within combustion chamber 28 at or near a TDC position. As piston 14 travels toward a BDC position after combustion, the volume decreases and pressure increases within pressure 50. The increasing pressure causes low pressure check valve LPC to close and high pressure check valve HPC to open. The high pressure hydraulic fluid which is forced through high pressure check valve during the return stroke is in communication with high pressure hydraulic accumulator H, resulting in a net positive gain in pressure within high pressure hydraulic accumulator H.

Figure 2:
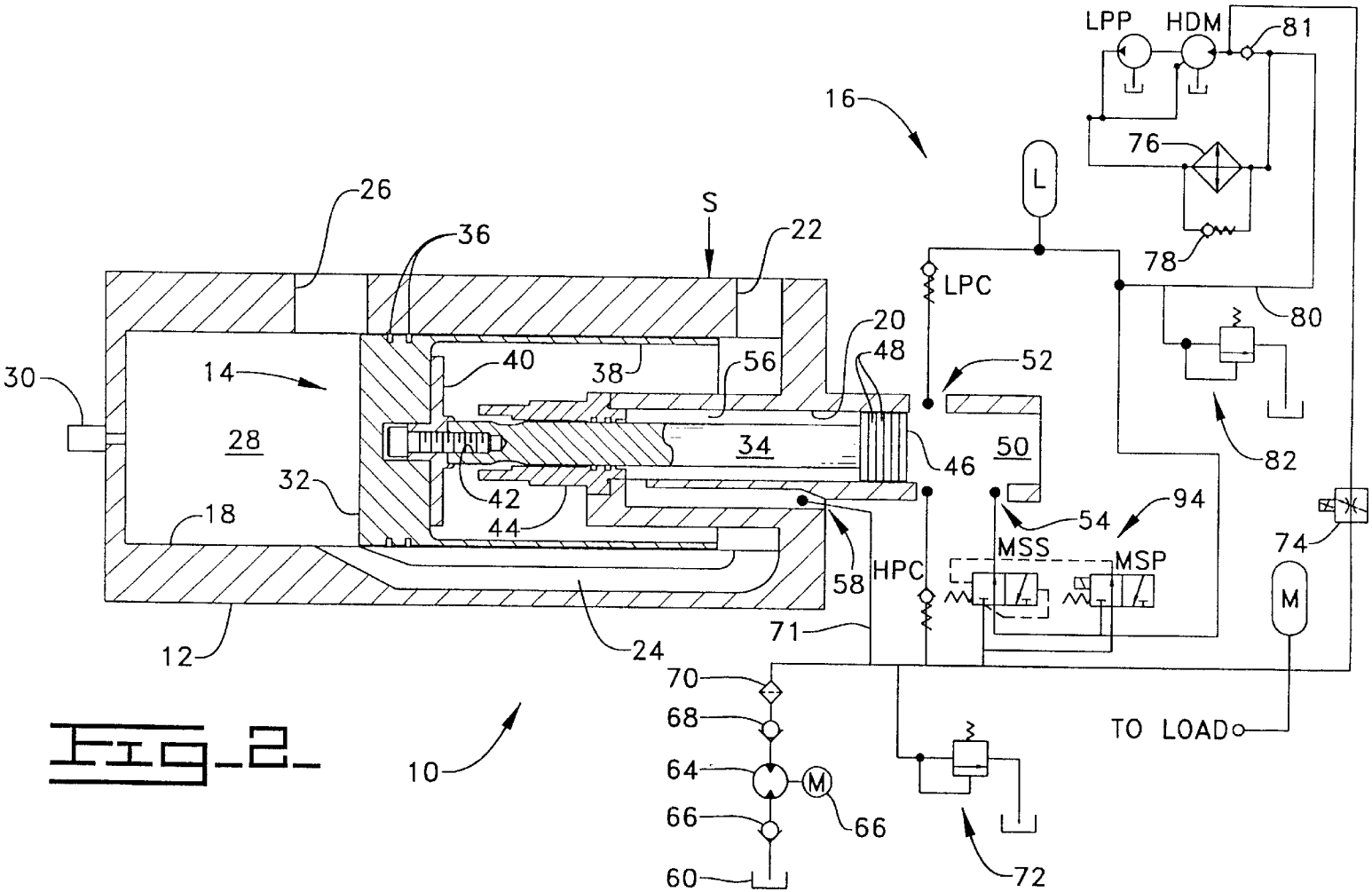
FIG. 2 is a schematic illustration of another embodiment of a free piston engine of the present invention.

FIG. 2 illustrates another embodiment of a free piston internal combustion engine 90 of the present invention, including a combustion cylinder and piston arrangement which is substantially the same as the embodiment shown in FIG. 1. Hydraulic circuit 92 of free piston engine 90 also includes many hydraulic components which are the same as the embodiment of hydraulic circuit 16 shown in FIG. 1. Hydraulic circuit 92 principally differs from hydraulic circuit 16 in that hydraulic circuit 92 includes a mini-servo valve 94 with a mini-servo main spool (MSS) and a mini-servo pilot (MSP). Mini-servo main spool MSS is controllably actuated at selected points in time during operation of free piston engine 90 to effect the high pressure pulse of high pressure hydraulic fluid from high pressure hydraulic accumulator H, similar to the manner described above with regard to the embodiment shown in FIG. 1. Mini-servo pilot MSP is controllably actuated to provide the pressure necessary for controllably actuating mini-servo main spool MSS. The pulse of high pressure hydraulic fluid is provided to pressure chamber 50 for a duration which is either dependent upon time or a sensed position of piston 14. Once mini-servo pilot MSP is closed, the volume within pressure chamber 50 increases and the pressure correspondingly decreases, resulting in an opening of low pressure check valve LPC. Low pressure hydraulic fluid from low pressure hydraulic accumulator L thus flows into pressure chamber 50 during the compression stroke of piston 14. After combustion and during the return stroke of piston 14, the pressure within pressure chamber 50 increases, thereby causing low pressure check valve LPC to close and high pressure check valve HPC to open. The high pressure hydraulic fluid created within pressure chamber 50 during the return stroke of piston 14 is pumped through high pressure check valve HPC and into high pressure hydraulic accumulator H, thereby resulting in a net positive gain in the pressure within high pressure hydraulic accumulator H.

Figure 3:
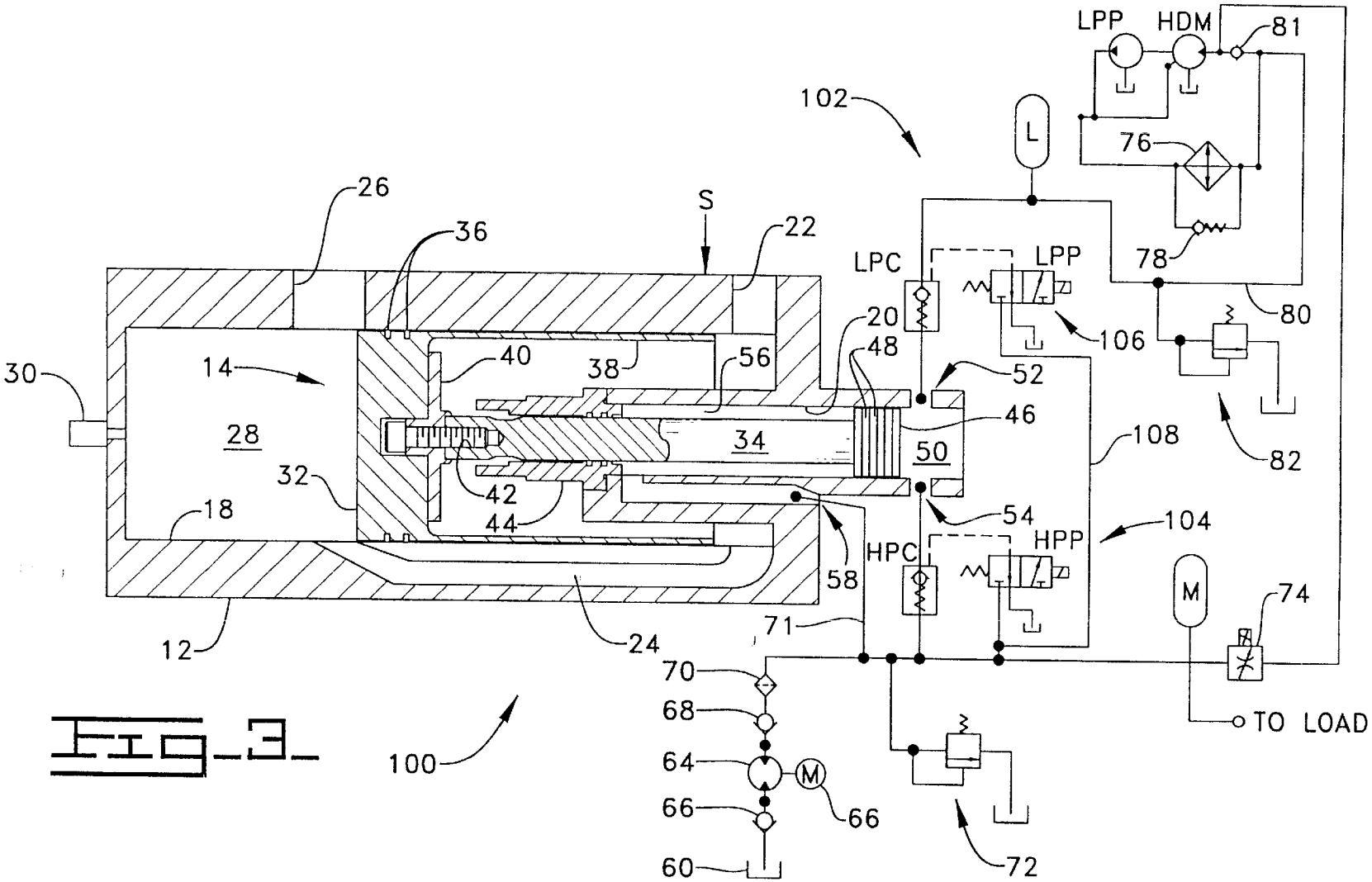
FIG. 3 is a schematic illustration of yet another embodiment of a free piston engine of the present invention.

Referring now to FIG. 3 there is shown yet another embodiment of a free piston engine 100 of the present invention. Again, the arrangement of combustion cylinder 18 and piston 14 is substantially the same as the embodiment of free piston engines 10 and 90 shown in FIGS. 1 and 2. Hydraulic circuit 102 also likewise includes many hydraulic components which are the same as the embodiments of hydraulic circuits 16 and 92 shown in FIGS. 1 and 2. However, hydraulic circuit 102 includes two pilot operated check valves 104 and 106. Pilot operated check valve 104 includes a high pressure check valve (HPC) and a high pressure pilot valve (HPP) which operate in a manner similar to high pressure check valve HPC and high pressure pilot is valve HPP described above with reference to the embodiment shown in FIG. 1. Pilot operated check valve 106 includes a low pressure check valve (LPC) and a low pressure pilot valve (LPP) which also work in a manner similar to high pressure check valve 104. The input side of low pressure pilot valve LPP is connected with the high pressure fluid within high pressure hydraulic accumulator H through line 108. Low pressure pilot valve LPP may be controllably actuated using a controller to provide a pulse of pressurized fluid to low pressure check valve LPC which is sufficient to open low pressure check valve LPC.

During use, a pulse of high pressure hydraulic fluid may be provided to pressure chamber 50 using pilot operated check valve 104 to cause piston 14 to travel toward a TDC position with enough kinetic energy to effect combustion. High pressure pilot valve HPP is deactuated, dependent upon a period of time or a sensed position of piston 14, to thereby allow high pressure check valve HPC to close. As plunger head 46 moves toward the TDC position, the pressure within pressure chamber 50 decreases and low pressure-check valve LPC is opened. Low pressure hydraulic fluid thus fills the volume within pressure chamber 50 while the volume within pressure chamber 50 expands. After combustion, piston 14 moves toward a BDC position which causes the pressure within pressure chamber 50 to increase. The increase causes low pressure check valve LPC to close and high pressure check valve to open. The high pressure hydraulic fluid which is generated by the pumping action of plunger head 46 within hydraulic cylinder 20 flows into high pressure hydraulic accumulator H, resulting in a net positive gain in the pressure within high pressure hydraulic accumulator H. A sensor (shematically illustrated and positioned at S) detects piston 14 near a BDC position. The high pressure pulse to effect the compression stroke can be timed dependent upon the sensor activation signal.

To effect a manual return procedure using the embodiment of free piston engine 100 shown in FIG. 3, high pressure hydraulic fluid is provided into annular space 56 from high pressure hydraulic accumulator H. Low pressure pilot valve LPP is controllably actuated to cause low pressure check valve LPC to open. The pressure differential on opposite sides of plunger head 46 causes piston 14 to s move toward a BDC position. When piston 14 is at a position providing an effective compression ratio to effect combustion within combustion chamber 28, a high pressure pulse of hydraulic fluid is transported into pressure chamber 50 using pilot operated check valve 104 to begin the compression stroke of piston 14.

In the embodiment shown in FIGS. 1–3 and described above, piston 14 includes a plunger rod 34 having a plunger head 46 which is monolithically formed therewith. However, it is also possible that plunger head 46 may be separate from and attached to plunger rod 34.

INDUSTRIAL APPLICABILITY

During use, a fuel and air mixture is loaded into combustion chamber 28 of free piston engine 10, 90 or 100. A high pressure pulse of high pressure hydraulic fluid is introduced into pressure chamber 50 from high pressure hydraulic accumulator H. The pulse of high pressure hydraulic fluid causes piston 14 to move toward a TDC position with enough kinetic energy to effect combustion within combustion chamber 28. After the pulse of high pressure hydraulic fluid is applied to pressure chamber 50, the fluid connection with high pressure hydraulic accumulator H is closed and the fluid connection with low pressure hydraulic accumulator L is opened. The expanding volume within pressure chamber 50 is filled with a lower pressure hydraulic fluid during the remainder of the compression stroke. During the return stroke, the fluid connection with low pressure hydraulic accumulator L is closed and the fluid connection with high pressure hydraulic H is opened. Movement of hydraulic plunger 46 toward the BDC position causes high pressure hydraulic fluid to be pumped into high pressure hydraulic accumulator H, thereby resulting in a net positive gain in the pressure within high pressure hydraulic accumulator H.

The fluid pressure in the pressure chamber in the hydraulic cylinder is used both to move the piston head to the TDC position during a compression stroke and to pressurize the hydraulic accumulator during a return stroke. Only a pulse of high pressure energy from the high pressure hydraulic accumulator is used during the compression stroke, and the high pressure hydraulic accumulator is pressurized during substantially all of the return stroke, thereby resulting in a net positive gain in the pressure in the high pressure hydraulic accumulator.

Other aspects, objects and advantages of this invention can be obtained from a study of the drawings, the disclosure and the appended claims.

What is claimed is:

1. A free piston internal combustion engine, comprising:

a housing including a combustion cylinder and a single hydraulic cylinder;

a piston including a piston head reciprocally disposed within said combustion cylinder and movable during a compression stroke to a top dead center position and during a return stroke to a bottom dead center position, a plunger head reciprocally disposed within said hydraulic cylinder, and a plunger rod interconnecting and rigidly affixed to each of said piston head and said plunger head, said plunger head and said hydraulic cylinder defining a variable volume pressure chamber on a side of said plunger head generally opposite said plunger rod;

a hydraulic accumulator; and at least one valve interconnecting said hydraulic accumulator with said pressure chamber during a portion of said compression stroke to act on said plunger head and thereby move said piston head toward said top dead center position, and interconnecting said hydraulic accumulator with said pressure chamber during said return stroke to pressurize said hydraulic accumulator during movement of said piston head toward said bottom dead center position.

2. The free piston internal combustion engine of claim 1, wherein said at least one valve comprises one valve which is selectively actuatable to interconnect said hydraulic accumulator with said pressure chamber during said portion of said compression stroke, and actuatable by a pressure differential to interconnect said pressure chamber with said hydraulic accumulator during said return stroke.

3. The free piston internal combustion engine of claim 2, wherein said one valve comprises a pilot operated check valve.

4. The free piston internal combustion engine of claim 1, wherein said at least one valve comprises two valves, one of said valves being selectively actuatable to interconnect said hydraulic accumulator with said pressure chamber during said portion of said compression stroke, and an other of said valves being actuatable by a pressure differential to interconnect said pressure chamber with said hydraulic accumulator during said return stroke.

5. The free piston internal combustion engine of claim 4, wherein said one valve comprises a high-speed servo valve and said other valve comprises a poppet valve.

6. The free piston internal combustion engine of claim 1, wherein said at least one valve interconnects said hydraulic accumulator with said pressure chamber during a beginning portion of said compression stroke.

7. The free piston internal combustion engine of claim 1, wherein said hydraulic accumulator comprises a high pressure hydraulic accumulator, and further comprising:

a low pressure hydraulic accumulator; and a valve interconnecting said low pressure fluid accumulator with said pressure chamber during a remaining portion of said compression stroke.

8. The free piston internal combustion engine of claim 7, wherein said valve is actuatable by a pressure differential to interconnect said pressure chamber with said low pressure hydraulic accumulator during said remaining portion of said compression stroke.

9. The free piston internal combustion engine of claim 1, wherein said plunger head has a diameter which is larger than a diameter of said plunger rod.

10. The free piston internal combustion engine of claim 1, wherein said plunger head is monolithic with said plunger rod.

11. A vehicle having a free piston internal combustion engine, said vehicle comprising:

a housing including a combustion cylinder and a hydraulic cylinder;

a piston including a piston head reciprocally disposed within said combustion cylinder and movable during a compression stroke to a top dead center position and during a return stroke to a bottom dead center position, a plunger head reciprocally disposed within said hydraulic cylinder, and a plunger rod interconnecting and rigidly affixed to each of said piston head and said plunger head, said plunger head and said hydraulic cylinder defining a variable volume pressure chamber on a side of said plunger head generally opposite said plunger rod;

a hydraulic load;

a single hydraulic accumulator fluidly coupled with said hydraulic load; and at least one valve interconnecting said hydraulic accumulator with said pressure chamber during a portion of said compression stroke to act on said plunger head and thereby move said piston head toward said top dead center position, and interconnecting said hydraulic accumulator with said pressure chamber during said return stroke to pressurize said hydraulic accumulator during movement of said piston head toward said bottom dead center position.

12. A vehicle having a free piston internal combustion engine, said vehicle comprising:

a housing including a combustion cylinder and a hydraulic cylinder;

a piston including a piston head, a plunger head, and a plunger rod, said piston head reciprocally disposed within said combustion cylinder and movable during a compression stroke to a top dead center position and during a return stroke to a bottom dead center position, said plunger head reciprocally disposed within said hydraulic cylinder, said plunger rod having a first rod end and a second rod end, said piston head being rigidly connected to said first rod end, said plunger head being rigidly connected to said second rod end, said plunger head and said hydraulic cylinder defining a variable volume pressure chamber on a side of said plunger head generally opposite said plunger rod;

a hydraulic load;

at least one hydraulic accumulator, each hydraulic accumulator being fluidly coupled with said variable volume pressure chamber, one said hydraulic accumulator being a load accumulator fluidly coupled with said hydraulic load; and at least one valve interconnecting said load accumulator with said variable volume pressure chamber during a portion of said compression stroke to act on said plunger head and thereby move said piston head toward said top dead center position, and interconnecting said load accumulator with said variable volume pressure chamber during said return stroke to pressurize said load accumulator during movement of said piston head toward said bottom dead center position.

13. The vehicle of claim 1, wherein said plunger head is the only plunger head connected to said plunger rod.

14. The vehicle of claim 11, wherein said plunger head is the only plunger head connected to said plunger rod.

15. The vehicle of claim 12, wherein said plunger head is the only plunger head connected to said plunger rod.

* * * * *